US010737869B2

(12) United States Patent
Graf et al.

(10) Patent No.: US 10,737,869 B2
(45) Date of Patent: Aug. 11, 2020

(54) LUNCHBOX

(71) Applicant: Faitron AG, St. Gallen (CH)

(72) Inventors: Fabian Graf, Zurich (CH); Pascal Mogy, Wadenswil (CH)

(73) Assignee: Faitron AG, St. Gallen (CH)

( * ) Notice: Subject to any disclaimer, the term of this patent is extended or adjusted under 35 U.S.C. 154(b) by 702 days.

(21) Appl. No.: 15/312,869

(22) PCT Filed: May 19, 2015

(86) PCT No.: PCT/IB2015/053684

§ 371 (c)(1),
(2) Date: Nov. 21, 2016

(87) PCT Pub. No.: WO2015/177726

PCT Pub. Date: Nov. 26, 2015

(65) Prior Publication Data

US 2017/0137205 A1 May 18, 2017

(30) Foreign Application Priority Data

May 21, 2014 (CH) ..... 0773/14

(51) Int. Cl.
*B65D 81/18* (2006.01)
*B65D 81/34* (2006.01)
(Continued)

(52) U.S. Cl.
CPC ..... *B65D 81/3476* (2013.01); *A45C 11/20* (2013.01); *A45C 13/005* (2013.01);
(Continued)

(58) Field of Classification Search
None
See application file for complete search history.

(56) References Cited

U.S. PATENT DOCUMENTS 3,602,691 A * 8/1971 Frazier ..... A47J 47/14 126/262
3,806,699 A * 4/1974 Hannivig ..... A45C 11/20 126/262
(Continued)

FOREIGN PATENT DOCUMENTS

DE 19807388 A1 * 9/1999 ..... A47J 47/14
DE 10157494 B4 3/2011
(Continued)

OTHER PUBLICATIONS

CN 201375438Y, Electric Lunch Box, Zhou, Jan. 6, 2010, Abstract and figure. (Year: 2010).*
(Continued)

*Primary Examiner* — Joseph M Pelham
(74) *Attorney, Agent, or Firm* — Muncy, Geissler, Olds & Lowe, P.C.

(57) ABSTRACT

The invention relates to a lunchbox for storing, transporting and heating food, in particular food prepared for consumption. This should be easy to handle.
The lunchbox comprises an upper shell (1) and a lower shell (2) which connected to one another in a hinged manner on one longitudinal side, wherein a closure is provided on the opposite longitudinal side. A shell having a circumferential and L-shaped angled edge region is arranged in the lower shell (2), which is assigned a thermal insulation and a heating element, wherein a groove for receiving a seal is formed in the circumferential edge region of the shell.

14 Claims, 4 Drawing Sheets

Figure 1:
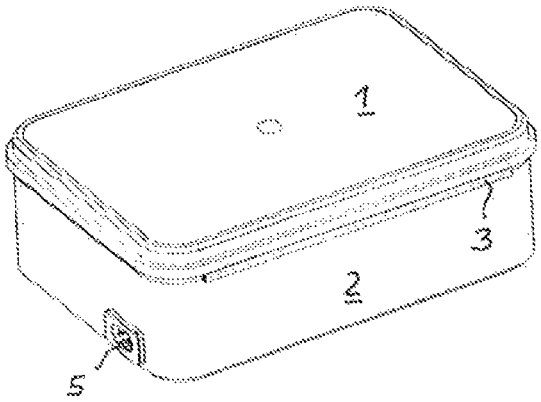

(51) Int. Cl.

| | |
|---|---|
| ***A45C 11/20*** | (2006.01) |
| ***B65D 81/38*** | (2006.01) |
| ***A45C 13/00*** | (2006.01) |
| ***B65D 43/16*** | (2006.01) |
| ***B65D 43/22*** | (2006.01) |

(52) U.S. Cl.
CPC ..... *B65D 43/163* (2013.01); *B65D 43/22* (2013.01); *B65D 81/3813* (2013.01); *B65D 81/3823* (2013.01)

(56) References Cited

U.S. PATENT DOCUMENTS 3,808,401 A * 4/1974 Wright ..... A47J 47/14 165/58
3,814,900 A * 6/1974 Frey ..... A47J 37/0611 219/218
3,869,595 A * 3/1975 Collins ..... A45C 11/20 219/387
4,037,081 A * 7/1977 Aldridge ..... A45C 11/20 219/387
4,420,678 A * 12/1983 Kalb ..... A45C 11/20 219/387
4,969,558 A * 11/1990 Fisher ..... A45C 11/20 126/261
5,569,401 A * 10/1996 Gilliland ..... A47K 10/06 219/386
5,974,686 A * 11/1999 Nomura ..... A47J 36/027 219/735
6,144,016 A * 11/2000 Garvin ..... A45C 11/20 206/550
6,541,738 B1 * 4/2003 Casasola ..... A45C 11/20 219/387
9,326,498 B2 * 5/2016 Lindsey ..... A01M 1/2094
2008/0121630 A1 * 5/2008 Simard ..... A45C 11/20 219/387

FOREIGN PATENT DOCUMENTS

| | | | |
|---|---|---|---|
| DE | 202013010997 | U1 | 1/2014 |
| EP | 0412159 | B1 | 6/1994 |
| WO | 2011/112284 | A1 | 9/2011 |

OTHER PUBLICATIONS

DE 198 07 388 A1, "Method for Transporting Hot Food in a Container," Sep. 1999, Mai, partial translation. (Year: 1999).*
International Search Report of PCT/IB2015/053684.

* cited by examiner

LUNCHBOX

This application is a national stage of International Application No.: PCT/IB2015/053684, which was filed on May 19, 2015, and which claims priority to CH 00773/14 which was filed on May 21, 2014, and which are both herein incorporated by reference.

The present invention relates to a lunchbox for storing, transporting and heating food, in particular food prepared for consumption.

Lunchboxes for storing and transporting food, which is to be eaten on the go or at the workplace, have been used for many decades. Two-part boxes made of metal or plastic are known, having a hinged lid or a attachable lid, having a large lower part for a main meal or having overlapping, approximately same-size upper and lower parts for rolls or similar.

In the retail trade, one- or two-part disposable containers, usually consisting of foam, are used usually in order to supply ready-to-eat portions of fruits, vegetables or ready meals.

Known from DE 202013010997 U1 is a hinged container which is designed so that when opening an upper shell, no items can fall out. The hinged container consists of an upper shell and a lower shell which are connected to one another in a hinged manner on one longitudinal side. A snap closure is provided on the opposite longitudinal side. The upper shell is provided with an upper inner lid and the lower shell is provided with a lower inner lid, so that the two internal volumes can be closed completely and independently of one another. On the side opposite the hinge of the inner lid, a lid closure in the form of a snap-in lug is provided in each of the upper shell and the lower shell.

Another lunchbox made of plastic for storing food is disclosed in DE 10157494 B4. This consists of a container with side walls, a base and a mounded-on lid. Located on the underside of the container is an additional chamber which can be closed with an additional lid. Lid and additional lid are connected to the container by means of a film hinge.

Another container with lid for storing food contains an exothermic heating element according to EP 0412159 B1. The container comprises an upper inner container for the materials to be heated and a lower inner container located thereunder which contains water and an exothermic material, wherein the lower inner container is provided with a cover. The container further comprises a device which can be operated from outside for contacting the exothermic material with the water. The cover of the lower inner container is permeable to steam but impermeable to the exothermic material.

The water and the exothermic material are provided in separate pouches which can be torn open separately.

Such a solution is expensive and only suitable for stationary operation.

A transportable and heatable lunchbox is also known. The lunchbox comprises an upper shell and a lower shell which are connected to one another in a hinged manner on one longitudinal side, wherein a closure is provided on the opposite longitudinal side. An inner container which can be closed with an attachable lid can be inserted in the lower shell. Indentations for cutlery are formed in the upper shell. The lower shell is provided with a power connection for a heating element in the lower shell, which is disposed in an insulation layer of foam. The heatability of food located in the inner container is limited or time-consuming.

It is now the object of the invention to provide a lunchbox which overcomes the disadvantages of the prior art and which is easy to handle.

The object is solved according to the invention by a lunchbox having the features of patent claim 1.

Preferred embodiments of the invention are disclosed in the dependent claims.

The lunchbox according to the invention is suitable for storing, transporting and heating food, in particular food ready for consumption. It can be used flexibly.

Figure 2:
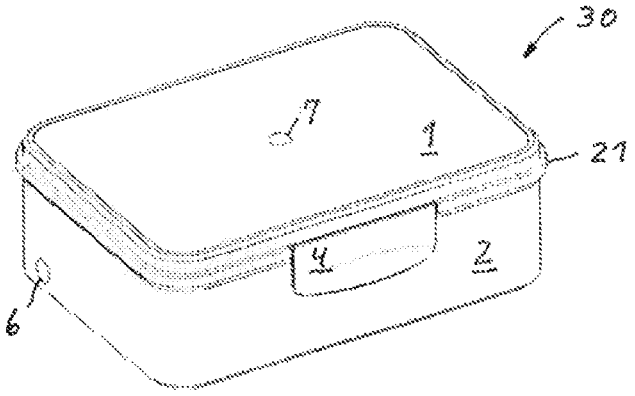
Figure 3:
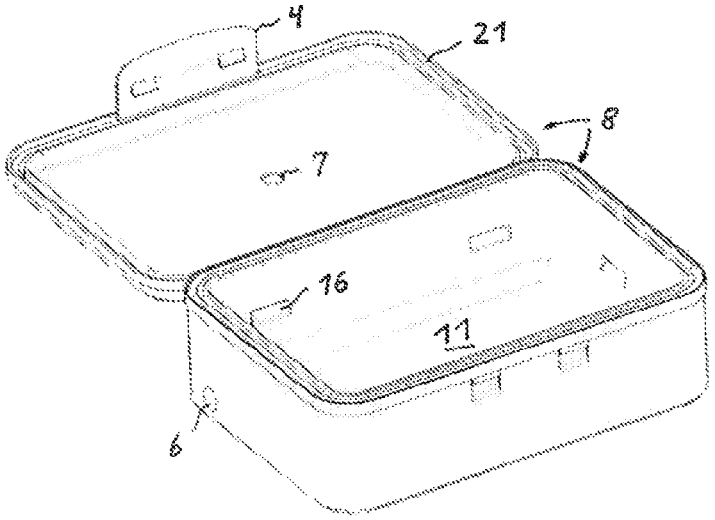
Figure 4:
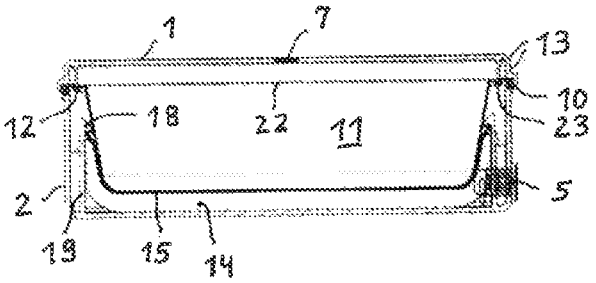
Figure 5:
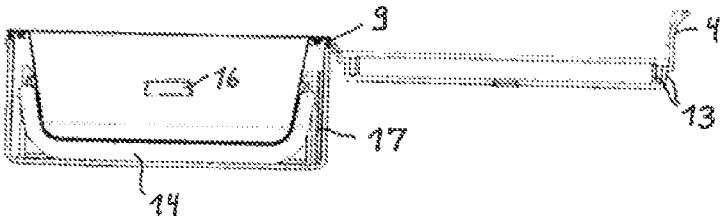
Figure 6:
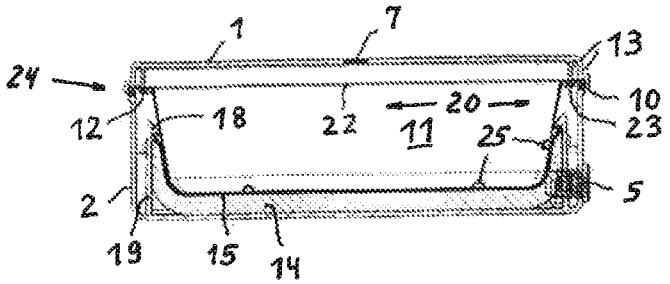

The invention will be described in detail hereinafter in an exemplary embodiment with reference to the drawings. In the drawings FIG. 1: shows a lunchbox according to the invention;

FIG. 2: shows the lunchbox according to FIG. 1 in a different view;

FIG. 3: shows the lunchbox according to FIG. 1, opened;

FIG. 4: shows the lunchbox according to FIG. 1 in section;

FIG. 5: shows the lunchbox according to FIG. 4, opened,

FIG. 6: shows details of the lunchbox according to FIG. 4.

A lunchbox 30 according to the invention (FIGS. 1, 2) comprises an upper shell 1 and a lower shell 2, in each case made of plastic and/or metal, for example, polypropylene (PP), wherein the upper shell 1 functions as a lid and is substantially flatter compared to the lower shell 2. The upper shell 1 and the lower shell 2 are connected to one another in a hinged manner on one longitudinal side by means of a moulded-on film hinge 3, wherein instead of the film hinge 3 a pivot hinge which is fastened to the upper and lower shell, or similar, is also possible.

By means of a pivot hinge the upper shell 1 could be opened up with respect to the film hinge and it would also be easier to replace than in the case of a film hinge.

A snap-in closure 4 (or snap closure) is provided on the side opposite the film hinge 3.

Upper shell 1 and lower shell 2 lie flat in the dividing plane 22 and abut against one another in an overlapping manner with an overhang 21 of the upper shell 1.

In the example, the height of the lower shell 2 is a multiple of the height of the upper shell 1, at least one and a half times.

A power connection socket 5 is provided on a longitudinal wall of the lower shell 2, wherein this can be configured in the form of a usual plug and also as a USB connection. Alternatively or additionally, such a power connection socket 5 can also be provided in the upper shell 1.

Furthermore, an LED 6 as a status display (heating) and start button is disposed on the longitudinal wall of the lower shell 2. A pressure compensating element 7, not described in detail, is provided in the upper shell 1.

The circumferential edge regions 8 (FIG. 3) of upper shell 1 and lower shell 2 are configured to correspond in shape so that they can function as a seal or can receive a sealing element 9. This sealing element is inserted in a near-edge groove 10 of the lower shell 2.

A shell 11 for holding the food to be heated is also part of the lunchbox 30.

The shell 11 is formed for example of an aluminium material having a thickness of 0.5 mm and disposed in the lower shell 2. The shell 11 has a circumferentially moulded-on edge region which is angled in an L shape.

The shell 11 is suspended in the groove 10 of the lower shell 2 by means of the smaller leg 24 of the edge region. A groove 23 in which a seal 12, for example, an O ring, is inserted, is likewise formed in the longer horizontal leg of the circumferential edge region. During closure of the upper shell 1 a double web 13 presses gently onto the seal 12 (FIG.

4), fixes this and the edge region of the shell 11 so that a tight closure of the lunchbox 30 is achieved in the dividing plane 22.

The shell 11 can additionally be fixed in position in the lower shell 2 by means of snap-in lugs 16, 18 and/or click connections. For this purpose the lower shell has at least two spaced-apart shafts 19 near the wall which are provided with a snap-in lug 18 at the upper end (FIGS. 4, 5).

However, a snap-in element with a snap-in lug could also be placed on the shafts 19, wherein in this embodiment the shafts 19 would be configured without snap-in lugs 18.

These snap-in lugs 18 of the snap-in element press against the snap-in lugs 16 formed on the shell 11 so that the shell 11 is fixed in its position.

The shell 11 can easily be removed from the lower shell 2 for cleaning or other purposes.

Instead of this type of fastening, an arrangement of the shell 11 by means of an adhesive connection or similar would also be possible. In this case, the sealing element 9 could be omitted.

The shell 11 and the lower shell 2 are adapted to one another or matched to one another in their design and shaping, for example by means of the snap-in lugs 16 and corresponding-shape mating elements of the shell 11.

Thus, shells 11 which are differently shaped in detail can be used or inserted into the lower shell 2.

For example, dimples 25, a snap-in element or a guide rail can be provided in the base region of the lower shell 2 in order to pre-define the shell shape used. By means of a precisely fitting shape on these dimples, the shell 11 is held in its position and also cannot be inserted upside down (safety feature). The dimples 25 at the same time serve for easy exchange of the shell 11 in order to ensure that the shell 11 is always inserted correctly.

As a further safety element, tensioned positioning grids 20, positioning gussets or the like which hold the shell 11 in its position can also be provided in the edge region of the lower shell 2. They afford the possibility of possibly also providing another guide rail in the side region of the lower shell 2.

Provided between the inner wall of the lower shell 2 and the shell 11 is a thermal insulation, for example made of a PUR integral foam, wherein another heating element 15 with a heating film is attached between this and the shell 11. The thermal insulation 14 could however also be formed from a Keraguss S moulding, an aerogel moulding or an EPS moulding.

Thermal insulation 14 and heating film 15 can cover the base region of the shell 11 (FIG. 5) or also preferably also surround or enclose the side walls of the shell 11 at least as far as the snap-in lugs 16 (FIG. 4).

In addition, the inner side of the upper shell 1 can also be provided with such a thermal insulation 14 and a heating element 15.

A connection between the power connection socket 5 and a control electronic unit 17 as well as to the heating element 15 is made by means of cable connections not shown.

The control electronic unit 17 is located on a flat board which in turn is placed in a space-saving manner on the inner wall of the lower shell 2 (FIG. 5). The control electronic unit 17 contains the electronic control, a safety circuit, a load switch and also a power pack. The electronic control should comprise at least a temperature sensor, a heating switch, the start-stop switch and the output for the LED 6. The electronic control can also allow different heating modes, for example lower and/or upper heat.

The heating element 15 consists in a manner known per se of a metallic heating film which is embedded between two silicone layers for electrical insulation. However, for example, Kapton heating films, polyester heating films or contact heating elements can be used. The power supply can comprise 5 V to 240 V, including the usual tolerances. For example, at 5 V or 12 V DC no special safety measures need to be provided. In an embodiment using 230 V DC, the shell 11 must either be earthed or the aforesaid double electrical insulation must be attached. When selecting the connection variants, the current rating, temperature and resistance to cleaning agents must be taken into account. The electrical connections are watertight.

The heating power of the heating film 15 should be at least about 20-150 W in order to enable heating of the food if necessary up to about 140° C. Depending on the food, lower or higher heating powers can be permissible wherein the values also depend on whether a heating element is only provided in the lower shell 2 or is also provided in the upper shell 1. When a heating element is arranged in the upper shell 1, its heating power is normally less than in the lower shell 2. The lunchbox is connected to the power source to heat the food and the start button which actuates the LED 6. By lighting up the LED 6 signals the heating process over a time duration pre-set in the control electronics 17. After the heating time has elapsed, the control electronic unit switches off the heating film and the LED 6 goes out. Other operating modes can be programmed.

REFERENCE LIST

1 Upper shell
2 Lower shell
3 Film hinge
4 Snap-in closure
5 Power connection socket
6 LED
7 Pressure compensating element
8 Edge region
9 Sealing element
10 Groove
11 Shell
12 Seal
13 Double web
14 Insulation
15 Heating element
16 Snap-in lugs
17 Control electronic unit
18 Snap-in lugs
19 Shaft
20 Positioning grid
21 Overhang
22 Dividing plane
23 Groove
24 Leg
25 Dimple
30 Lunchbox

The invention claimed is:

1. A lunchbox for storing, for transporting and for heating food, in particular food prepared for consumption, comprising;

an upper shell and a lower shell, which are connected to one another in a hinged manner on one longitudinal side, wherein a closure is provided on the opposite longitudinal side;

a shell having a circumferential and angled edge region being arranged in the lower shell, which comprises a thermal insulation and a film-type electrical heating element;

a groove for receiving a seal being formed in the circumferential edge region of the shell; and a power connection socket provided on the upper shell and/or the lower shell, wherein the thermal insulation and the heating element extend at least over the base of the shell and at least partially enclose the side walls of the shell.

2. The lunchbox according to claim 1, wherein a pressure equalizing element is attached in the upper shell.

3. The lunchbox according to claim 1, wherein the upper shell also comprises a thermal insulation and an electrical heating element.

4. The lunchbox according to claim 1, wherein the circumferential edge of the shell is located in the region of a dividing plane between the upper shell and the lower shell.

5. The lunchbox according to claim 4, wherein the upper shell and the lower shell abut against one another flat and in an overlapping manner in the dividing plane.

6. The lunchbox according to claim 1, wherein the circumferential edge regions of the upper shell and the lower shell are configured to be corresponding in shape and fulfilling a sealing function.

7. The lunchbox according to claim 1, wherein the shell has an L-shaped edge region.

8. The lunchbox according to claim 1, wherein the electrical heating element comprises a heating film.

9. The lunchbox according to claim 1, further comprising an electronic control unit.

10. The lunchbox according to claim 9, wherein the electronic control unit is disposed on the lower shell and connected to the power connection socket.

11. The lunchbox according to claim 9, wherein the electronic control unit is configured to allow different heating modes in the lunchbox.

12. A lunchbox for storing, for transporting and for heating food, comprising:

an upper shell;

a lower shell connected to the upper shell in a hinged manner on one longitudinal side, wherein a closure is provided on an opposite longitudinal side;

a shell arranged in the lower shell to receive heatable foods, the shell having a circumferential and angled edge region, the shell comprising:

a thermal insulation;

a film-type electrical heating element; and a groove formed in the circumferential and angled edge region of the shell;

a seal configured to be received in the groove; and a power connection socket provided on the upper shell or the lower shell.

13. A lunchbox for storing, for transporting and for heating food, in particular food prepared for consumption, comprising;

an upper shell and a lower shell, which are connected to one another in a hinged manner on one longitudinal side, wherein a closure is provided on the opposite longitudinal side;

a shell having a circumferential and angled edge region being arranged in the lower shell, which comprises a thermal insulation and a film-type electrical heating element; and a groove for receiving a seal being formed in the circumferential edge region of the shell; and wherein the thermal insulation and the heating element extend at least over the base of the shell and at least partially enclose the side walls of the shell.

14. A lunchbox for storing, for transporting and for heating food, in particular food prepared for consumption, comprising;

an upper shell and a lower shell, which are connected to one another in a hinged manner on one longitudinal side, wherein a closure is provided on the opposite longitudinal side;

a shell having a circumferential and angled edge region being arranged in the lower shell, which comprises a thermal insulation and a film-type electrical heating element;

a groove for receiving a seal being formed in the circumferential edge region of the shell;

a power connection socket provided on the upper shell and/or the lower shell; and an electronic control unit, wherein the thermal insulation and the heating element extend at least over the base of the shell and at least partially enclose the side walls of the shell.

* * * * *